US006464039B1

(12) United States Patent
Urmson et al.

(10) Patent No.: US 6,464,039 B1
(45) Date of Patent: Oct. 15, 2002

(54) ACTUATOR ELEMENT OF A HYDRAULIC FLUID-OPERATED RAILWAY TRACK LUBRICATING SYSTEM

(75) Inventors: William T Urmson, Valencia; Frank T. Lenco, Bellevue; John W. Mospan, Pittsburgh, all of PA (US)

(73) Assignee: Portec Rail Products, Inc., Pittsburgh, PA (US)

( * ) Notice: Subject to any disclaimer, the term of this patent is extended or adjusted under 35 U.S.C. 154(b) by 97 days.

(21) Appl. No.: 09/658,313

(22) Filed: Sep. 8, 2000

(51) Int. Cl.[7] ..... B61K 3/00
(52) U.S. Cl. ..... 184/3.1; 238/161.5
(58) Field of Search ..... 238/161.5; 291/3; 184/2, 3.1

(56) References Cited

U.S. PATENT DOCUMENTS

| | | | | | |
|---|---|---|---|---|---|
| 2,349,259 | A | | 5/1944 | Fuller | |
| 2,355,241 | A | * | 8/1944 | Rodman et al. | 184/3 |
| 2,401,303 | A | | 6/1946 | Huber | |
| 2,486,600 | A | | 11/1949 | Huber et al. | |
| 2,643,738 | A | | 6/1953 | Magnus | |
| 2,779,291 | A | | 1/1957 | Albright | |
| 2,965,036 | A | | 12/1960 | Wood | |
| 4,334,596 | A | | 6/1982 | Lounsberry, Jr. | |
| 5,076,396 | A | * | 12/1991 | Foote | 184/3.1 |
| 5,503,536 | A | * | 4/1996 | Waldenstrom et al. | 417/229 |
| 5,518,085 | A | * | 5/1996 | Houser, Jr. et al. | 184/3.1 |
| 5,641,037 | A | * | 6/1997 | Wise et al. | 184/3.1 |
| 5,687,814 | A | * | 11/1997 | Craig et al. | 184/3.2 |

* cited by examiner

*Primary Examiner*—David Fenstermacher
(74) *Attorney, Agent, or Firm*—Pietragallo, Bosick & Gordon

(57) ABSTRACT

A retrofit for an actuator element in a railway track lubricating apparatus for applying lubricant to a rail of a railway track includes a housing with a chamber, an enclosure block, a spacer element for occupying the space in existing actuator elements, a T-shaped plunger with a base adjacent a coil spring, and an actuator stem movable in a bore in the top of the housing, and wherein the stem is supported by and in sealed communication with a bushing that is placed within the cavity of the bore. A hydraulic fluid inlet opening is located at the bottom of the housing and a hydraulic fluid outlet opening is located at the top of the housing. A second embodiment provides an actuator element for use in new lubricating systems whereby the actuator element is mounted onto the rail and does not involve a spacer element in the chamber of the actuator element.

12 Claims, 3 Drawing Sheets

ACTUATOR ELEMENT OF A HYDRAULIC FLUID-OPERATED RAILWAY TRACK LUBRICATING SYSTEM

BACKGROUND OF THE INVENTION

1. Field of the Invention

The present invention relates to a system for lubricating the rails of a railway track, and more specifically, to an actuator element which is located on or in the ground next to the rails to be lubricated and which is activated by the passing of the wheels of a railway vehicle thereby. In particular, the present invention is directed to an improved actuator element of such a lubricating system operated by the internal circulation of a hydraulic fluid.

2. Description of the Background Art

Lubricating devices that are positioned next to the rails of a railway track and that are activated by the passage of the wheels of the railway vehicle to discharge a lubricant onto the rail head are well known. The application of lubricant to the rails has been found to reduce the frictional wear on the railhead and the degree of noise between the flanges of the wheels and the railhead. Many of the known lubricating devices include a lubricant supply tank located in the ground near the rail, one or more lubricant distributing elements positioned on one side of the rail, a pump in the supply tank for conveying lubricant through one or more pipes to the lubricant distributing elements positioned on one side of the rail, and an actuator element located along the length of the rail. The actuator element is suitably connected to the pump and operates the pump in response to the passage of the wheels of the railway vehicle over the actuator element.

In some of the present-day lubricating devices, the connection between the actuator element and the pump in the supply tank is mechanical, involving an elongated rotatable drive rod with attendant joints, springs, bearings, etc. However, over time, these mechanical elements deteriorate due to wear and tear. Additionally, in order to function these lubricating devices must be located above the ground next to the rail. This location of these devices generally results in damage to the devices particularly when the railway vehicle derails or when rail equipment is dragged along the tracks. From this, it can easily be appreciated that a lubricating device using a mechanical connection is often undesirable.

Further known lubricating devices include a connection between the actuator element and the pump in the supply tank that consists of either a single hydraulic fluid line or a recirculating fluid loop in which hydraulic fluid, such as light oil is caused to flow by the activation of the actuator element. An example of a lubricating device consisting of a single hydraulic fluid line is disclosed in U.S. Pat. No. 2,355,241 to Rodman, et al. In this device, the actuator element and the pump both function by the expansion and contraction of bellows. These bellows tend to break down over time due to the experienced expansion and contraction stresses. This results in costly replacement of the lubricating device.

An example of a lubricating device consisting of a recirculating fluid loop is disclosed in U.S. Pat. No. 2,401,303 to Huber. In this type of lubricating device, the construction of the actuator element is complicated, and therefore, expensive and difficult to service. The pump, being in the form of a gun pump, has an intricate internal mechanism that frequently breaks down.

U.S. Pat. No. 4,334,596 to Lounsberry discloses a lubricating apparatus for the rail of a railway track which is simpler in design compared to those of the known art discussed herein above. The lubricating system employs a hydraulic fluid recirculating loop between the actuator element and the lubricant pump in the lubricant-containing supply tank. The lubricant pump is a combined gear drive-gear pump device where the gear drive is driven by the flow of hydraulic fluid there through and the gear pump is driven by the gear drive so as to force lubricant from the supply tank to the lubricant distributing elements mounted on the rail.

The actuator element of the above U.S. Pat. No. 4,334,596 has an upper coil spring located between a plunger and a piston, and a lower coil spring located between the piston and a plug located at the bottom of an elongated block. Hydraulic fluid is forced into and out of the chamber of the actuator element upon movement of the piston and plunger. When the fluid is forced out of the actuator element, it actuates a lubricating system that delivers lubricant to the rail.

There are several disadvantages associated with the actuator element of the above U.S. Pat. No. 4,334,596. The input and output lines for the hydraulic fluid are in communication with the lower part of the chamber where the piston generally keeps the fluid in this lower part of the chamber. When the actuator element is new, little or no lubrication travels to the upper part of the chamber whereby the frictional forces between the plunger and the bore wall tend to interfere or decrease the power in the system that is generated on the down stroke of the piston. After wear of the piston, the fluid seeps up between the piston and the chamber wall and into the top part of the chamber affecting both the power in the down stroke and in the up stroke of the piston. Additionally, it has been found that the upper spring, being heavier in construction and the stronger of the two springs, allows for less free travel and develops compression stresses and high fatigue due to the frequent and tremendous forces from the wheels of the rail cars. Failure of the upper spring and the loss of power in the actuator elements result in failure of the lubricating system.

There is, therefore, a need in the art to provide an improved actuator element for a lubricating system that lessens the likelihood of power and/or component failure, i.e. spring failure, so that the performance of the lubricating system for the rail of a railway track is enhanced and maintained.

SUMMARY OF THE INVENTION

The present invention has met this need. The invention relates to an actuator element for activating a lubricating system for supplying lubricant to the side of a rail. The actuator element of the invention is used in conjunction with a railway track lubricating apparatus that employs a hydraulic fluid recirculating loop between the actuator element and the lubricant pump.

In a first embodiment of the invention which is used to retrofit existing lubricating system field units, the actuator element comprises a housing with top and bottom surfaces, a hydraulic fluid chamber extending inwardly from the bottom surface of the housing, and a bore communicating between the chamber and the top surface of the housing. The housing includes a radial hydraulic fluid outlet located in the upper part of the chamber and a radial hydraulic fluid inlet opening located in the lower part of the chamber. Both openings are in association with the hydraulic fluid recirculation system whereby hydraulic fluid passes into and out of the chamber of the actuator element. A plunger having a base and a stem is mounted in the housing such that the base is movable along the chamber and the stem is movable along the bore at the top of the housing. An enclosure block is connected at the bottom of the housing and has a stem extending into the chamber toward the plunger. A spacer element is mounted onto the stem of the enclosure block, and in turn, has a stem which positions a coil spring located between the spacer element and the plunger.

When the wheel of a railway vehicle passes over the stem of the plunger, the base of the plunger moves down in the chamber and against the spring. As the stem of the plunger enters the chamber, hydraulic fluid is forced out of the chamber and through the radial hydraulic fluid outlet for operation of a motor pump that delivers lubricant or grease to the lubricant distributing elements mounted on the side of the rail.

When the wheel of the railway vehicle has passed over and clears the stem of the plunger, the spring pushes the base of the plunger upward in the chamber housing and hydraulic fluid is drawn back into the housing chamber of the actuator element.

The diameter of the plunger stem is such that the plunger stem is supported by and is in sealed communication with a bushing. The bushing is in the cavity of the bore and is in communication with the internal wall of the bore. The diameter of the plunger base is such that the plunger base is spaced away from the wall of the chamber. These dimensions for the diameters of the plunger base and wall of the chamber do not create a seal and therefore hydraulic fluid H travels from the hydraulic fluid inlet opening to the hydraulic fluid outlet.

A second embodiment of the invention comprises an actuator element that does not require a spacer element in the housing chamber. This actuator element is preferably employed with newly installed lubricating systems; whereas, the actuator element of the first embodiment is used as a retrofit to existing lubricating systems.

It will be appreciated by those skilled in the art that the present invention provides an improved actuator element for a lubricating apparatus that has a simplified design compared to the actuator elements of the prior art, i.e. one or more components are eliminated, whereby the performance of the lubricating apparatus for the rail of the railway track is enhanced.

BRIEF DESCRIPTION OF THE DRAWINGS

The features of the present invention will be apparent from the following description, by way of example of preferred embodiments, with reference to the accompanying drawings of which.

DETAILED DESCRIPTION OF THE INVENTION

Figure 1:
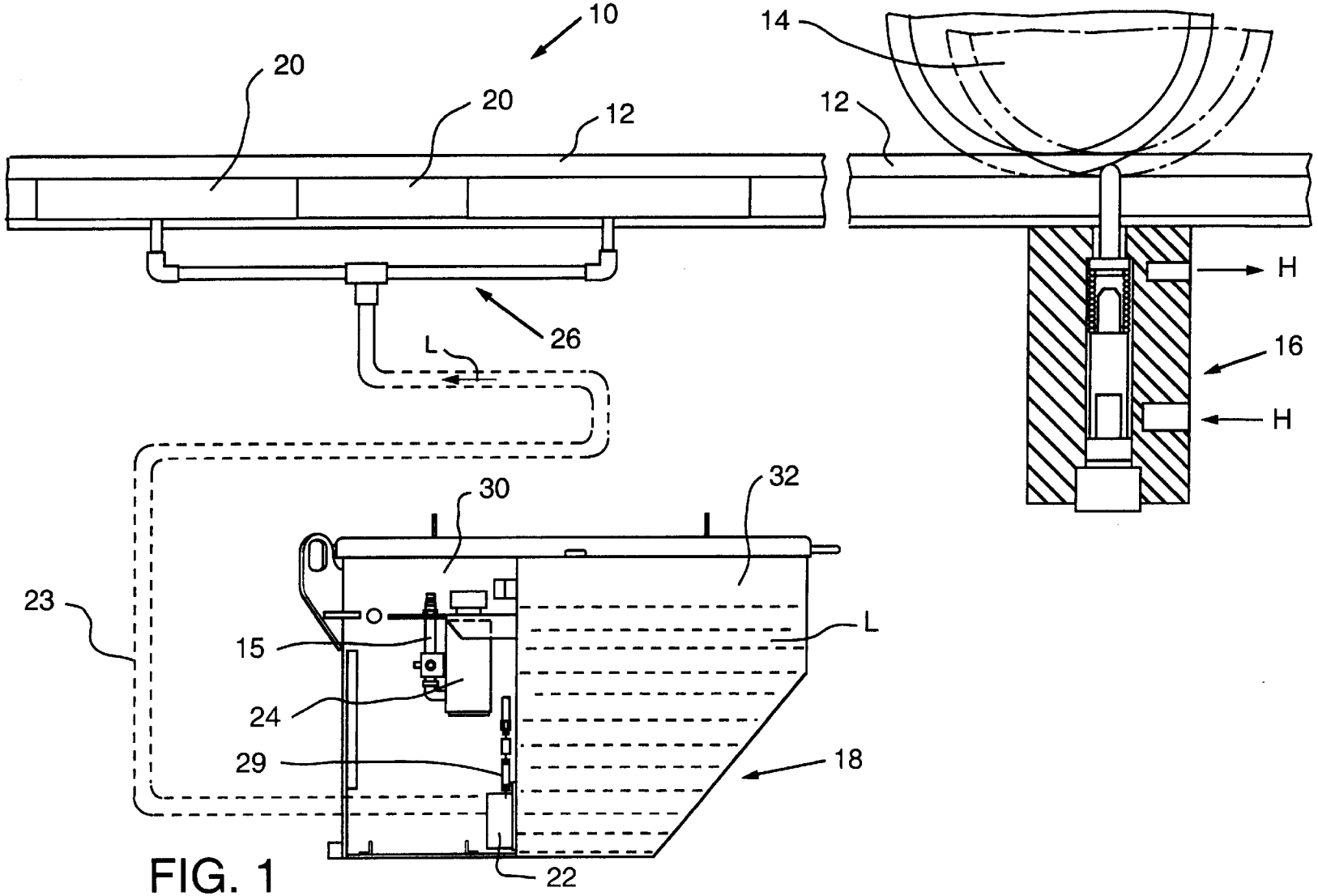
FIG. 1 is a schematic representation of the hydraulic fluid-operated railway track lubricating system incorporating an actuator element of a first embodiment of the present invention located adjacent to a rail of a railway track.

Referring first to FIG. 1, a hydraulic fluid operated lubricating system for a railway track in which the actuator element 16 of the invention is incorporated generally is identified as 10. Lubricating system 10 is located adjacent a rail 12 of a railway track so as to supply lubricant or grease to rail 12 in response to the passage of a wheel 14 of a railway vehicle, i. e. train, along rail 12. Many of the components of lubricating system 10 are buried in the ground in order to avoid possible damage to these components upon derailment of the vehicle or upon other physical impacts from equipment used in railway lines.

The principles and operation of lubricating system 10 generally are similar to those of the aforesaid U.S. Pat. No. 4,334,596, the teachings of which are incorporated herein by reference.

Lubricating system 10 comprises a covered supply tank 18 which contains lubricant L; a series of lubricant applicators 20 which are positioned in spaced apart fashion along the side of rail 12; a lubricant motor pump assembly 22 which is located within supply tank 18; a hydraulic fluid reservoir assembly 24 which is located within supply tank 18; a lubricant delivery system generally labeled 26 which is connected between pump assembly 22 and applicators 20 so as to convey lubricant L pumped from supply tank 18 to each of the several applicators 20, as schematically illustrated by line 23; actuator element 16 which is positioned along rail 12 for activation by wheel 14; and a hydraulic fluid recirculation system 15, which is not shown in detail but which is associated with actuator element 16, hydraulic fluid reservoir assembly 24, and motor pump assembly 22 to circulate hydraulic fluid H, such for example, light oil, from actuator element 16 to hydraulic fluid reservoir assembly 24, which, in turn, through hydraulic lines, such as that indicated at 29, delivers hydraulic fluid H to and from lubricant motor pump assembly 22 for activation of pump assembly 22 and for delivery of lubricant L to applicators 20. These components of lubricating system 10 operate similar to the aforesaid U.S. Pat. No. 4,334, 596.

Supply tank 18 has two main compartments 30, 32. Compartment 32 retains lubricant L that is delivered to applicators 20, and is structured so as to keep lubricant L completely separate from the other components of the supply tank 18 and to prevent lubricant L from contaminating the components located in adjacent compartment 30. Compartment 30 is designed to remain free of lubricant L and contains motor pump assembly 22, hydraulic fluid reservoir assembly 24, and hydraulic lines 29 in addition to other components (not shown) that are necessary for the complete operation of lubricating system 10.

It is believed that it is not necessary to show all the components used in the lubricating system 10 for operation of actuator element 16 since these components are apparent to one skilled in the art. It is important to appreciate that the operation of lubricating system 10 is similar to that of the aforesaid U.S. Pat. No. 4,334,596 in that actuator element 16 is activated by wheel 14; hydraulic fluid H is forced out of actuator element 16 and is delivered to reservoir assembly 24. Hydraulic fluid is then delivered through hydraulic fluid delivery means for delivering hydraulic fluid similar to that represented by hydraulic lines 29 to drive motor pump assembly 22, which in turn, pumps lubricant L through a lubricant delivery means for delivering lubricant similar to that indicated at 26 into applicators 20.

Figure 1A:
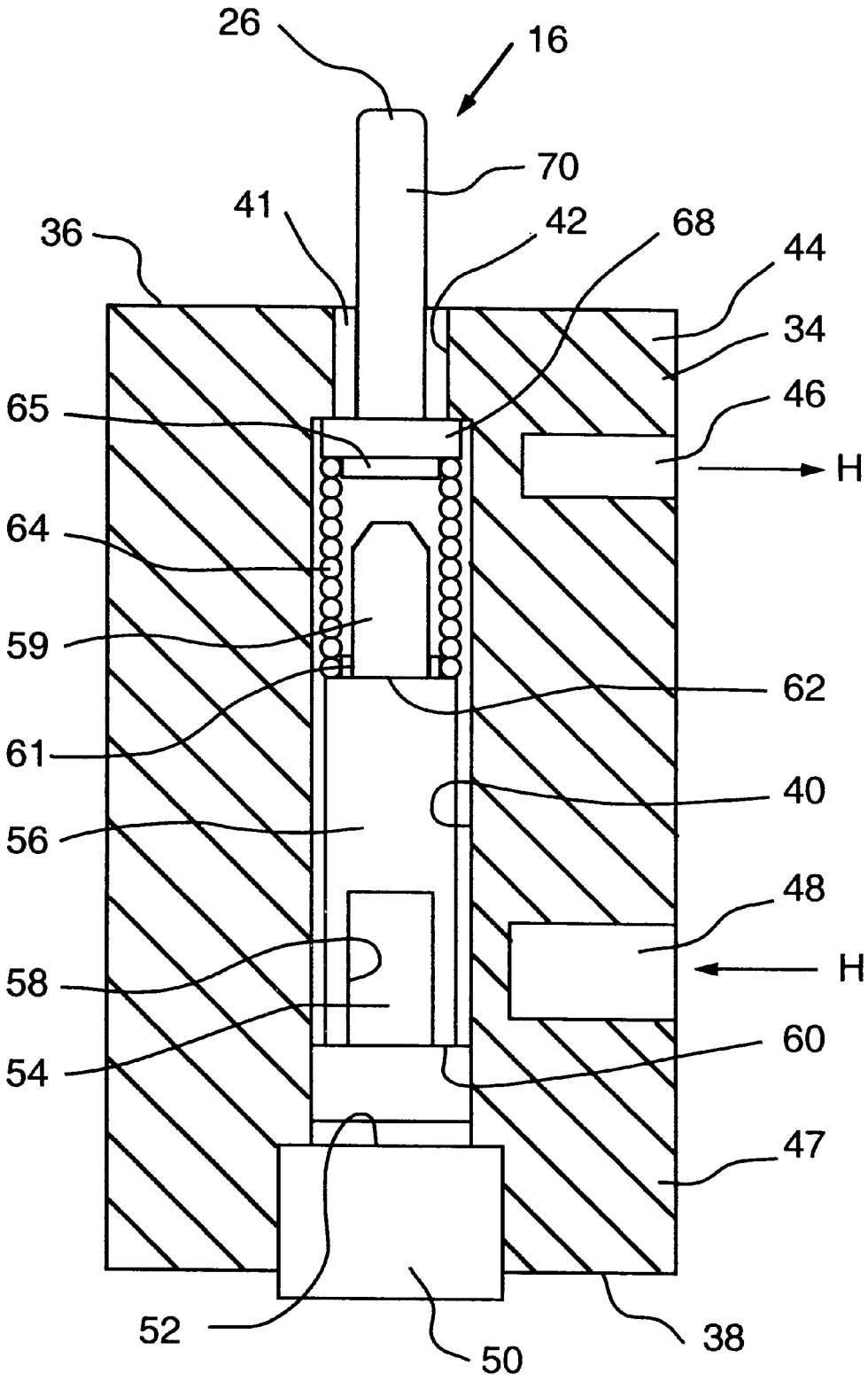
FIG. 1A is an enlarged view of an actuator element of the first embodiment that is shown in FIG. 1.

Turning now to the description of actuator element 16, reference is made particularly to FIG. 1A. Actuator element 16 includes a housing 34 having a top surface 36, a bottom surface 38, a cylindrical chamber 40 extending inwardly from the bottom surface 38, and a cylindrical bore 42 communicating with chamber 40 and extending between chamber 40 and top surface 36 of housing 34. As is illustrated in FIG. 1A, bore 42 has a diameter that is less than the diameter of chamber 40.

Located at an upper part 44 of chamber 40 and in communication with chamber 40 is a radial hydraulic fluid outlet opening 46 and located at a lower part 47 of chamber 40 and in communication with chamber 40 is a radial hydraulic fluid inlet opening 48. Outlet and inlet openings 46 and 48, respectively, through conduit means well known to those skilled in the art for transporting the hydraulic fluid, are associated with a hydraulic fluid recirculation system, including reservoir assembly 24, of FIG. 1 whereby hydraulic fluid H passes within chamber 40 between lower part 47 and upper part 44 of chamber 40.

Fixedly mounted in bottom surface 38 of housing 34 is a circular enclosure block 50 for enclosing chamber 40 at the bottom. Enclosure block 50 has a collar 52 and a stem 54 that extends inwardly of chamber 40. Positioned around stem 54 is a circular spacer element 56. Spacer element 56 has a cylindrical bore 58 extending inwardly from its bottom surface 60 in which stem 54 of enclosure block is tightly fitted and a stem 59 with a collar 61 extending upwardly from its top surface 62. Positioned around stem 59 of spacer element 56 is a coil spring 64 which is seated in chamber 40 at its one end by collar 61 of spacer element 56 and at its other end by a collar 65 of a T-shaped plunger 66. T-shaped plunger 66 includes a base 68 adjacent to collar 65 and a stem 70. Plunger 66 is positioned inside of housing 34 such that its base 68 fits within and is movable along chamber 40 and its stem 70 is movable along bore 42 of housing 34. The length of stem 70 of plunger 66 is such that its tip extends beyond the top surface 36 of housing 34.

Coil spring 64 is pre-loaded to return plunger 66 to its home position as shown in FIG. 1A. Coil spring 64 is, such as for example but not limited to, made of tempered steel and has, such as for example but not limited to, a K constant of about 100 pounds per inch of travel. Coil spring 64 can be of similar physical characteristics of the upper spring used in the actuator element described in the aforesaid U.S. Pat. No. 4,334,596.

Still referring to FIG. 1A, the diameter of base 68 of plunger 66 is substantially less than the diameter of the inner wall of chamber 40 so that base 68 is spaced away from the inner wall of chamber 40, and the diameter of stem 70 of plunger 66 is substantially less than the diameter of the inner wall of bore 42 so that stem 70 is substantially spaced away from the inner wall of bore 42. Stem 70 is supported by and is in sealed communication with bushing 41. Bushing 41 is in the cavity of bore 42 and is in communication with the inner wall of bore 42. These dimensions for the diameter of the plunger base 68 and wall of the chamber 40 do not create a seal and therefore hydraulic fluid H travels from the hydraulic fluid inlet to the hydraulic fluid outlet. FIG. 1A shows that spacer element 56 is spaced away from the interior wall of chamber 40 to allow the hydraulic fluid H to pass freely within the chamber 40 between the lower part 47 and upper part 44 of chamber 40. The diameter of base 68 is flushed with the coil diameter of coil spring 64, and is sufficient to force coil spring 64 inwardly of chamber 40 without creating a seal against the inner wall of bore 42 and the inner wall of chamber 40.

Coil spring 64 is positioned between plunger 66 and spacer element 56 such that coil spring 64 is compressed by base 68 of plunger 66 when wheel 14 of a railway vehicle passes over stem 70 of plunger 66 to push plunger 66 in chamber 40 to force hydraulic fluid H out of the outlet opening 46 for operation of lubricant motor pump assembly 22 (FIG. 1) and delivery of lubricant L to applicators 20 and therefore, to rail 12. Coil spring 64 is released when wheel 14 passes over and clears stem 70 to return plunger 66 to its home base as shown in FIG. 1A. Inlet opening 48 acts as a suctioning means for creating a low pressure within the chamber 40, relative to the other components of the hydraulic fluid recirculation system, to draw the hydraulic fluid H back into chamber 40 upon the return of plunger 66 to its home base, and outlet opening 46 located at the upper part 44 of chamber 40. Check valves (not shown) well known by those skilled in the art are positioned near to or within inlet opening 48 and outlet opening 46 in order to allow hydraulic fluid H to flow in one direction.

Figure 2:
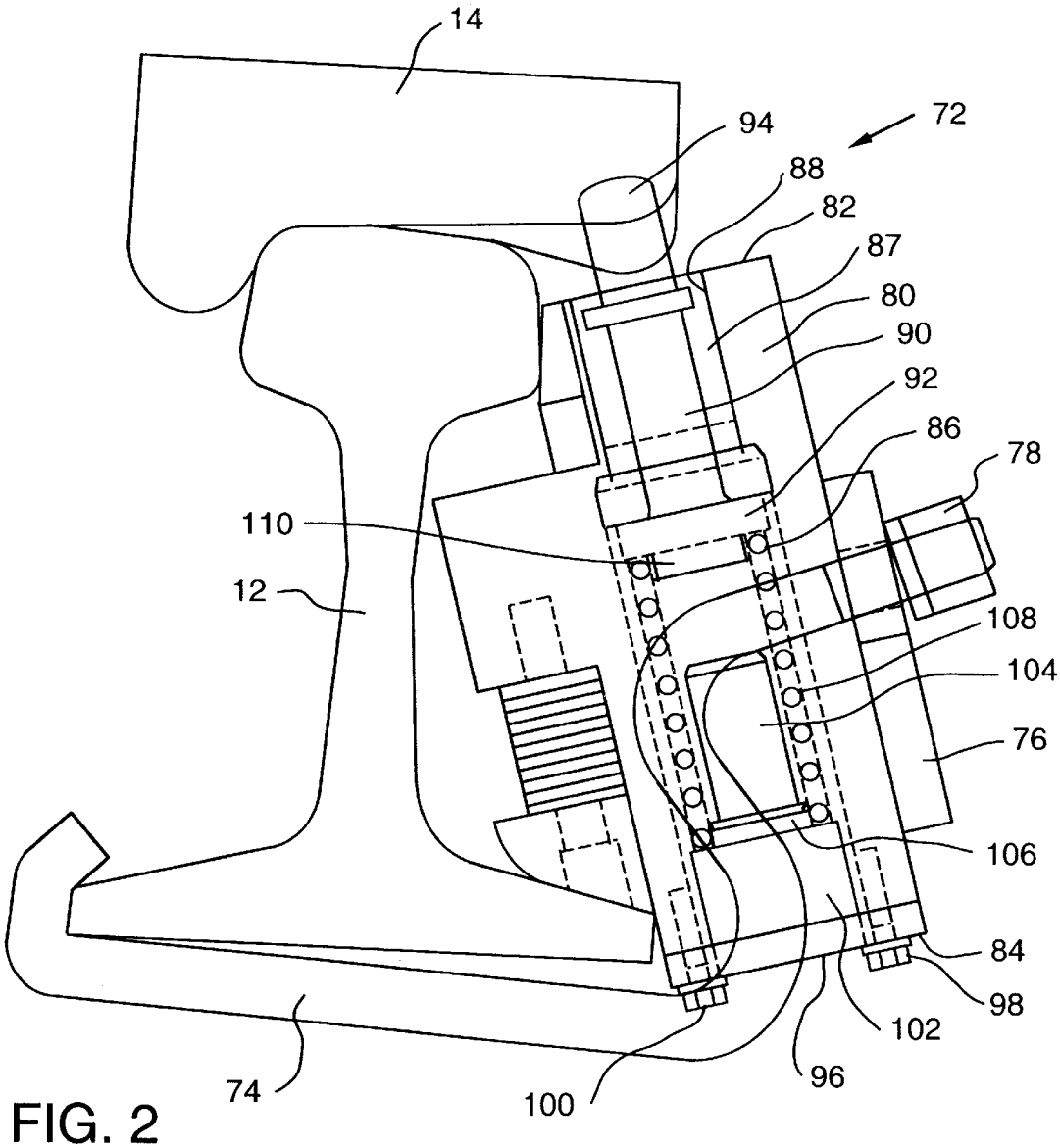
FIG. 2 is a schematic representation of an actuator element of a second embodiment of the invention mounted onto a rail of a railway track and which may be used in the lubricating system of FIG. 1.

FIG. 2 illustrates a second embodiment for an actuator element 72 of the instant invention. Actuator element 72 is mounted on bracket 74 by plate 76 and bolt 78 in a manner known to those skilled in the art. Bracket 74 is mounted under rail 12 and secures actuator element 72 against rail 12 in a slanted position for activation by wheel 14.

Actuator element 72 comprises a housing 80 having a top surface 82, a bottom surface 84, a cylindrical chamber 86 extending inwardly from bottom surface 84 and a cylindrical bore 88 communicating with chamber 86 and extending between chamber 86 and top surface 82. Housing 80 has a hydraulic outlet opening and a hydraulic inlet opening (not shown) that are similar to those of actuator element 16 of FIG. 1A.

A T-shaped plunger 90 having base 92 and stem 94 is positioned inside chamber 86 such that plunger base 92 fits within and is movable along chamber 86 and stem 94 is movable along bore 88. In its home position, stem 94 extends out of the top surface 82 of housing 80. The diameter of plunger base 92 and stem 94 is such that plunger base 92 and stem 94 are substantially spaced away from the inner wall of chamber 86 and the inner wall of bore 88, respectively, in a manner similar to that described herein above for actuator element 16. Stem 94 is supported by and is in sealed communication with bushing 87. Bushing 87 is in the cavity of the bore 88 and is in communication with the inner wall of bore 88.

An enclosure plate 96 is attached to the bottom surface 84 of housing 80 by bolts 98, 100. Plate 96 fixedly secures cylindrical block 102 in the lower part of chamber 86. Block 102 comprises a stem 104 extending upwardly in chamber 86 toward T-shaped plunger 90 and a collar 106 for seating a coil spring 108 within chamber 86 at the one end of coil spring 108. The other end of coil spring 108 is seated in chamber 86 by a collar 110 which is mounted on the under surface of base 92 of plunger 90. Coil spring 108 spaces base 92 away from the surface of stem 104 of block 102.

Actuator element 72 is similar to actuator element 16 in operation and in design except for the apparent differences illustrated in FIG. 2 and operates in the lubricating system of FIG. 1 in a manner similar to that described herein above for actuator element 16. The main difference between actuator elements 16 and 72, is that actuator element 16 includes a spacer element which is needed to take up the space in the chamber of existing actuator element designs. Use of actuator element 16 is more desirable for retrofitting known existing rail lubricating systems; whereas use of actuator element 72 is desirable in the installation of new lubricating systems. In most instances, the length of actuator element 72 would be less than that for actuator element 16. It will be appreciated by those skilled in the art that both economic and personnel time savings are advantages associated with the manufacturing and the employment of actuator element 72. Because actuator element 72 is shorter in length than the actuator element described in the background art, less material is required to manufacture actuator element 72 for use in the lubricating system of the present invention, and thus an economic cost savings results. Actuator element 72 is easier to install onto the rail over conventional systems as the instant invention requires less alteration of the ballast along the rail, and thus results in less personnel time required completing installation. In both embodiments of this invention, the clearances between the inner wall of the bore and the stem of the plunger and between the inner wall of the chamber and the base of the plunger require no machining, i.e. the inner walls of the bore and of the chamber, respectively, can remain rough and therefore can be drilled instead of bored and honed, therefore resulting in ease of manufacture. In both embodiments of the instant invention, the stem of the plunger acts as a piston to force hydraulic fluid out of and into the chamber for operation of the hydraulic fluid recirculation system loop between the actuator element and the lubrication pump for delivery of lubricant L to lubricant applicators 20 and thus increases efficiency.

Whereas particular embodiments of the instant invention have been described in detail for the purposes of illustration, it will be evident to those skilled in the art that numerous variations and details of the instant invention may be made without departing from the instant invention as defined in the appended claims.

We claim:

1. In a railway track lubricating system comprising at least one applicator element for applying lubricant to a rail of the railway track, a lubricant supply tank including a pump, a lubricant delivery system associated with said pump and with said applicator element, an actuator element positioned along the length of the rail to be activated by the wheel of the railway vehicle passing there over, and a hydraulic fluid system for delivering hydraulic fluid to and from said actuator element and said lubricant pump to operate said lubricant pump when said actuator element is activated for supplying said lubricant to said applicator element, said actuator element comprising:

a housing having a top surface, a bottom surface, a hydraulic fluid chamber extending inwardly from said bottom surface of said housing, and a bore communicating between said chamber and said top surface of said housing;

said housing including a hydraulic fluid outlet opening in communication with an upper part of said chamber and a hydraulic fluid inlet opening in communication with a lower part of said chamber, and said outlet and inlet openings being in association with said hydraulic fluid system whereby said hydraulic fluid passes within said chamber between said lower part and said upper part of said chamber;

a plunger having a base and a stem and mounted in said housing such that said base is movable along said chamber and said stem is movable along said bore at said top surface of said housing, and wherein said stem is supported by and is in sealed communication with a bushing, said bushing placed within the cavity of said bore such that said bushing is in communication with the inner wall of said bore;

an enclosure block mounted in said bottom surface of said housing and extending into said chamber;

a spacer element mounted in said chamber between said enclosure block and said plunger; and a coil spring positioned between said plunger and said spacer element such that said coil spring is compressed by said base of said plunger when said wheel of said railway vehicle passes over said stem of said plunger to move said plunger in said chamber to force at least said hydraulic fluid out of said outlet opening in said upper part of said chamber for operation of said lubricant pump and delivery of said lubricant to said applicator element and to said rail and such that said coil spring is released when said wheel of said railway vehicle passes over and clears said stem of said plunger to force said stem of said plunger out of said housing in preparation for further activation of said actuator element by another wheel of a railway vehicle and to create a low pressure within said chamber relative to said hydraulic fluid recirculation system so as to draw the hydraulic fluid through said inlet opening and into said chamber.

2. The railway track lubricating system of claim 1 wherein said stem of said plunger has a dimension such that said stem is substantially spaced away from the inner wall of said bore of said housing, and said base of said plunger has a dimension such that said base is substantially spaced away from the inner wall of said chamber such that the diameter of said base of said plunger is smaller relative to the diameter of the inner wall of said chamber so as not to create a seal against the inner wall of said chamber.

3. The railway track lubricating system of claim 2 wherein said spacer element has a dimension such that said spacer element is substantially spaced away from said inner wall of said chamber to allow said hydraulic fluid to pass freely within said chamber between said lower part and said upper part of said chamber, and wherein said base and said spacer element each have a collar for fixedly positioning said coil spring between said base and said spacer element.

4. An actuator element in a railway track lubricating system for supplying lubricant to a rail of a railway track and operated by a hydraulic fluid recirculation system whereby hydraulic fluid is conveyed to and from said actuator element upon activation of said actuator element by a wheel of a railway vehicle passing there over, said actuator element comprising:

a housing having a top surface, a bottom surface, a hydraulic fluid chamber extending inwardly from said bottom surface of said housing, and a bore communicating between said chamber and said top surface of said housing;

said housing including a hydraulic fluid outlet opening in communication with an upper part of said chamber and a hydraulic fluid inlet opening in communication with a lower part of said chamber, and said outlet and inlet openings being in association with said hydraulic fluid system whereby said hydraulic fluid passes within said chamber between said lower part and said upper part of said chamber;

a plunger having a base and a stem and mounted in said housing such that said base is movable along said chamber and said stem is movable along said bore at said top surface of said housing, and wherein said stem is supported by and is in sealed communication with a bushing, said bushing placed within the cavity of said bore such that said bushing is in communication with the inner wall of said bore;

an enclosure block mounted in said bottom surface of said housing and extending into said chamber;

a spacer element mounted in said chamber between said enclosure block and said plunger; and a coil spring positioned between said plunger and said spacer element such that said coil spring is compressed by said base of said plunger when said wheel of said railway vehicle passes over said stem of said plunger to move said plunger in said chamber to force at least said hydraulic fluid out of said outlet opening in said upper part of said chamber for operation of said lubricant pump and delivery of said lubricant to said applicator element and to said rail and such that said coil spring is released when said wheel of said railway vehicle passes over and clears said stem of said plunger to force said stem of said plunger out of said housing in preparation for further activation of said actuator element by another wheel of a railway vehicle and to create a low pressure within said chamber relative to said hydraulic fluid recirculation system so as to draw the hydraulic fluid through said inlet opening and into said chamber.

5. The actuator element of claim 4 wherein said stem of said plunger has a dimension such that said stem is substantially spaced away from the inner wall of said bore of said housing, and said base of said plunger has a dimension such that said base is substantially spaced away from the inner wall of said chamber such that the diameter of said base of said plunger is smaller relative to the diameter of the inner wall of said chamber so as not to create a seal against the wall of said chamber.

6. An actuator element of claim 5 wherein said spacer element has a dimension such that said spacer element is substantially spaced away from said inner wall of said chamber to allow said hydraulic fluid to pass freely within said chamber between said lower part and said upper part of said chamber, and wherein said base and said spacer element each have a collar for fixedly positioning said coil spring between said base and said spacer element.

7. In a railway track lubricating system comprising at least one applicator element for applying lubricant to a rail of the railway track, a lubricant supply tank including a pump, a lubricant delivery system associated with said pump and with said applicator element, an actuator element mountable on the rail for activation by the wheel of the railway vehicle passing there over, and a hydraulic fluid system for delivering hydraulic fluid to and from said actuator element and said lubricant pump to operate said lubricant pump when said actuator element is activated for supplying said lubricant to said applicator element, said actuator element comprising:

a housing having a top surface, a bottom surface, a hydraulic fluid chamber extending inwardly from said bottom surface of said housing, and a bore communicating between said chamber and said top surface of said housing;

said housing including a hydraulic fluid outlet opening in communication with an upper part of said chamber and a hydraulic fluid inlet opening in communication with a lower part of said chamber, and said outlet and inlet openings being in association with said hydraulic fluid system whereby said hydraulic fluid passes within said chamber between said lower part and said upper part of said chamber;

a plunger having a base and a stem and mounted in said housing such that said base is movable along said chamber and said stem is movable along said bore at said top surface of said housing, and wherein said stem is supported by and is in sealed communication with a bushing, said bushing placed within the cavity of said bore such that said bushing is in communication with the inner wall of said bore;

an enclosure block mounted in said bottom surface of said housing and extending into said chamber; and a coil spring positioned between said plunger and said enclosure block such that said coil spring is compressed by said base of said plunger when said wheel of said railway vehicle passes over said stem of said plunger to move said plunger in said chamber to force at least said hydraulic fluid out of said outlet opening in said upper part of said chamber for operation of said lubricant pump and delivery of said lubricant to said applicator element and to said rail and such that said coil spring is released when said wheel of said railway vehicle passes over and clears said stem of said plunger to force said stem of said plunger out of said housing in preparation for further activation of said actuator element by another wheel of a railway vehicle and to create a low pressure within said chamber relative to said hydraulic fluid recirculation system so as to draw the hydraulic fluid through said inlet opening and into said chamber.

8. The railway track lubricating system of claim 7 wherein said stem of said plunger has a dimension such that said stem is substantially spaced away from the inner wall of said bore of said housing, and said base of said plunger has a dimension such that said base is substantially spaced away from the inner wall of said chamber such that the diameter of said base of said plunger is smaller relative to the diameter of the inner wall of said chamber so as not to create a seal against the inner wall of said chamber, and whereby said dimensions of said stem and said base are sufficient to force said coil spring inwardly of said chamber without creating a seal against the inner walls of said bore and said chamber, respectively.

9. The railway track lubricating system of claim 8 wherein said coil spring is substantially spaced away from the inner wall of said chamber to allow said hydraulic fluid to pass freely within said chamber between said lower part and said upper part of said chamber, and wherein said plunger and said enclosure block each have a collar for fixedly positioning said coil spring between said plunger and said enclosure block.

10. An actuator element in a railway track lubricating system for supplying lubricant to a rail of a railway track and operated by a hydraulic fluid recirculation system whereby hydraulic fluid is conveyed to and from said actuator element upon activation of said actuator element by a wheel of a railway vehicle passing there over, said actuator element comprising:

a housing having a top surface, a bottom surface, a hydraulic fluid chamber extending inwardly from said bottom surface of said housing, and a bore communicating between said chamber and said top surface of said housing;

said housing including a hydraulic fluid outlet opening in communication with an upper part of said chamber and a hydraulic fluid inlet opening in communication with a lower part of said chamber, and said outlet and inlet openings being in association with said hydraulic fluid system whereby said hydraulic fluid passes within said chamber between said lower part and said upper part of said chamber;

a plunger having a base and a stem and mounted in said housing such that said base is movable along said chamber and said stem is movable along said bore at said top surface of said housing and wherein said stem is supported by and in sealed communication with a bushing, said bushing placed within the cavity of said bore such that said bushing is in communication with the inner wall of said bore;

an enclosure block mounted in said bottom surface of said housing and extending into said chamber; and a coil spring positioned between said plunger and said enclosure block such that said coil spring is compressed by said base of said plunger when said wheel of said railway vehicle passes over said stem of said plunger to move said plunger in said chamber to force at least said hydraulic fluid out of said outlet opening in said upper part of said chamber for operation of said lubricant pump and delivery of said lubricant to said applicator element and to said rail and such that said coil spring is released when said wheel of said railway vehicle passes over and clears said stem of said plunger to force said stem of said plunger out of said housing in preparation for further activation of said actuator element by another wheel of a railway vehicle and to create a low pressure within said chamber relative to said hydraulic fluid recirculation system so as to draw the hydraulic fluid through said inlet opening and into said chamber.

11. An actuator element of claim 10 wherein said stem of said plunger has a dimension such that said stem is substantially spaced away from the inner wall of said bore of said housing, and said base of said plunger has a dimension such that said base is substantially spaced away from the inner wall of said chamber such that the diameter of said base of said plunger is smaller relative to the diameter of the inner wall of said chamber so as not to create a seal against the inner wall of said chamber, and whereby said dimensions of said stem and said base are sufficient to force said coil spring inwardly of said chamber without creating a seal against the inner walls of said bore and said chamber, respectively.

12. An actuator element of claim 11 wherein said coil spring is substantially spaced away from the inner wall of said chamber to allow said hydraulic fluid to pass freely within said chamber between said lower part and said upper part of said chamber, and wherein said plunger and said enclosure block each have a collar for fixedly positioning said coil spring between said plunger and said enclosure block.

* * * * *